US010602895B2

(12) United States Patent
Kasper, Jr. et al.

(10) Patent No.: US 10,602,895 B2
(45) Date of Patent: Mar. 31, 2020

(54) BRUSHROLL FOR VACUUM CLEANER

(71) Applicant: BISSELL Homecare, Inc., Grand Rapids, MI (US)

(72) Inventors: Gary A. Kasper, Jr., Grand Rapids, MI (US); Todd Richard VanTongeren, Ada, MI (US); Jeffrey A. Scholten, Ada, MI (US); Jake Andrew Mohan, Grand Rapids, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 108 days.

(21) Appl. No.: 15/866,978

(22) Filed: Jan. 10, 2018

(65) Prior Publication Data

US 2018/0125315 A1 May 10, 2018

Related U.S. Application Data

(63) Continuation-in-part of application No. 14/966,139, filed on Dec. 11, 2015, now Pat. No. 9,883,779.

(60) Provisional application No. 62/090,959, filed on Dec. 12, 2014.

(51) Int. Cl.

| | |
|---|---|
| ***A47L 9/04*** | (2006.01) |
| ***A47L 5/30*** | (2006.01) |
| ***A46B 13/00*** | (2006.01) |

(52) U.S. Cl.

CPC ..... *A47L 9/0477* (2013.01); *A46B 13/001* (2013.01); *A47L 5/30* (2013.01); *A47L 9/0444* (2013.01); *A46B 2200/30* (2013.01)

(58) Field of Classification Search

CPC ..... A47L 9/0477; A47L 9/0466; A47L 5/30; A46B 13/001; A46B 13/005; A46B 13/006

See application file for complete search history.

(56) References Cited

U.S. PATENT DOCUMENTS

| | | | |
|---|---|---|---|
| 1,889,224 | A | 11/1932 | Smellie |
| 2,459,007 | A | 1/1949 | Taylor |
| 2,659,921 | A | 11/1953 | Osborn |
| 3,597,789 | A | 8/1971 | Boyd |
| 4,173,807 | A | 11/1979 | Maier |
| 4,912,805 | A | 4/1990 | Krasznai et al. |
| 5,003,663 | A | 4/1991 | Sunagawa et al. |
| 5,452,490 | A | 9/1995 | Brundula et al. |

(Continued)

FOREIGN PATENT DOCUMENTS

| | | |
|---|---|---|
| GB | 0584478 | 1/1947 |
| GB | 1321081 | 6/1973 |

(Continued)

OTHER PUBLICATIONS

PCT Notification of Transmittal of the International Search Report and Written Opinion dated Apr. 22, 2019.

*Primary Examiner* — Laura C Guidotti

(74) *Attorney, Agent, or Firm* — McGarry Bair PC

(57) ABSTRACT

A brushroll for a surface cleaning apparatus includes a brush dowel defining an axis and having opposing bristle supports and a shroud surface between the opposing bristle supports, and a plurality of bristles protruding from the bristle supports. The shroud surface includes opposing convex curved surfaces extending between the bristle supports which intersect the shroud surface at outside corners.

16 Claims, 9 Drawing Sheets

(56) References Cited

U.S. PATENT DOCUMENTS

| | | | | |
|---|---|---|---|---|
| 5,495,634 | A | 3/1996 | Brundula et al. | |
| 6,530,106 | B1 | 3/2003 | Brundula | |
| 6,539,575 | B1 | 4/2003 | Cohen | |
| 9,480,374 | B2 | 11/2016 | Li et al. | |
| 2005/0039282 | A1 | 2/2005 | Paterson et al. | |
| 2010/0306957 | A1 | 12/2010 | Follows et al. | |
| 2014/0143978 | A1 | 5/2014 | Li et al. | |
| 2014/0259522 | A1* | 9/2014 | Kasper | A47L 9/0477 15/383 |
| 2014/0304941 | A1 | 10/2014 | Eriksson | |
| 2014/0331446 | A1 | 11/2014 | Eriksson | |

FOREIGN PATENT DOCUMENTS

| | | | |
|---|---|---|---|
| GB | 1374420 | | 11/1974 |
| KR | 1020040096192 | A | 11/2004 |

* cited by examiner

BRUSHROLL FOR VACUUM CLEANER

CROSS REFERENCE TO RELATED APPLICATIONS

This application is a continuation-in-part of U.S. patent application Ser. No. 14/966,139, filed Dec. 11, 2015, now U.S. Pat. No. 9,883,779, which claims the benefit of U.S. Provisional Patent Application No. 62/090,959, filed Dec. 12, 2014, both of which are incorporated herein by reference in their entirety.

BACKGROUND

Vacuum cleaners can include an agitator for agitating debris on a surface to be cleaned so that the debris is more easily ingested into the vacuum cleaner. In some cases, the agitator comprises a brushroll that rotates within a base or floor nozzle. Such brushrolls can be rotatably driven by a motor, a turbine fan or a mechanical gear train, for example. Brushrolls typically have a generally cylindrical dowel with multiple bristle tufts extending radially from the dowel. In operation, debris on a surface to be cleaned is swept up by the brushroll; in some cases, elongated debris such as hair may become wrapped around the brushroll and must be removed by a user by manually pulling or cutting the hair off the brushroll.

BRIEF SUMMARY

According to one aspect of the invention, a brushroll for a vacuum cleaner includes a brush dowel configured to be mounted for rotation about a central rotational axis, which extends longitudinally through the brush dowel, and having opposing bristle supports defining mounting surfaces and a shroud surface comprising opposing convex curved surfaces extending between the opposing bristle supports, and a plurality of bristle tufts fastened to each of the opposing bristle supports and projecting from one of the mounting surfaces, wherein the mounting surfaces intersect the convex curved surfaces at outside corners.

DETAILED DESCRIPTION

The invention relates to vacuum cleaners and in particular to vacuum cleaners or accessory tools for vacuum cleaners having a rotatable brushroll. In particular, the invention relates to an improved brushroll design which reduces hair wrap. According to one aspect of the invention, a brushroll includes a dowel, a plurality of bristles protruding from the dowel, and a shroud surface which is positioned relative to the bristles to minimize hair wrap.

According to another aspect of the invention, a brushroll includes a dowel, a plurality of bristles protruding from the dowel, and a cutting channel which is positioned relative to the bristles to permit hair to be cut from the dowel.

According to another aspect of the invention, a brushroll includes concave curved tufting surfaces to which bristle tufts are mounted or secured to minimize hair wrap.

According to yet another aspect of the invention, a brushroll includes offset, swept bristle tufts that are tufted at an acute angle to reduce the drive torque required to rotate the brushroll.

The brushrolls can be used with various vacuum cleaners, including an upright-type vacuum cleaner, a canister-type vacuum cleaner, a stick vacuum cleaner, an autonomous or robotic vacuum cleaner, or a hand-held vacuum cleaner, or accessory tools therefore. Furthermore, the vacuum cleaner or accessory tool can additionally be configured to distribute a fluid and/or to extract a fluid, where the fluid may for example be liquid or steam. The term "surface cleaning apparatus" as used herein includes both vacuum cleaners and accessory tools for vacuum cleaners, unless expressly noted.

Figure 1:
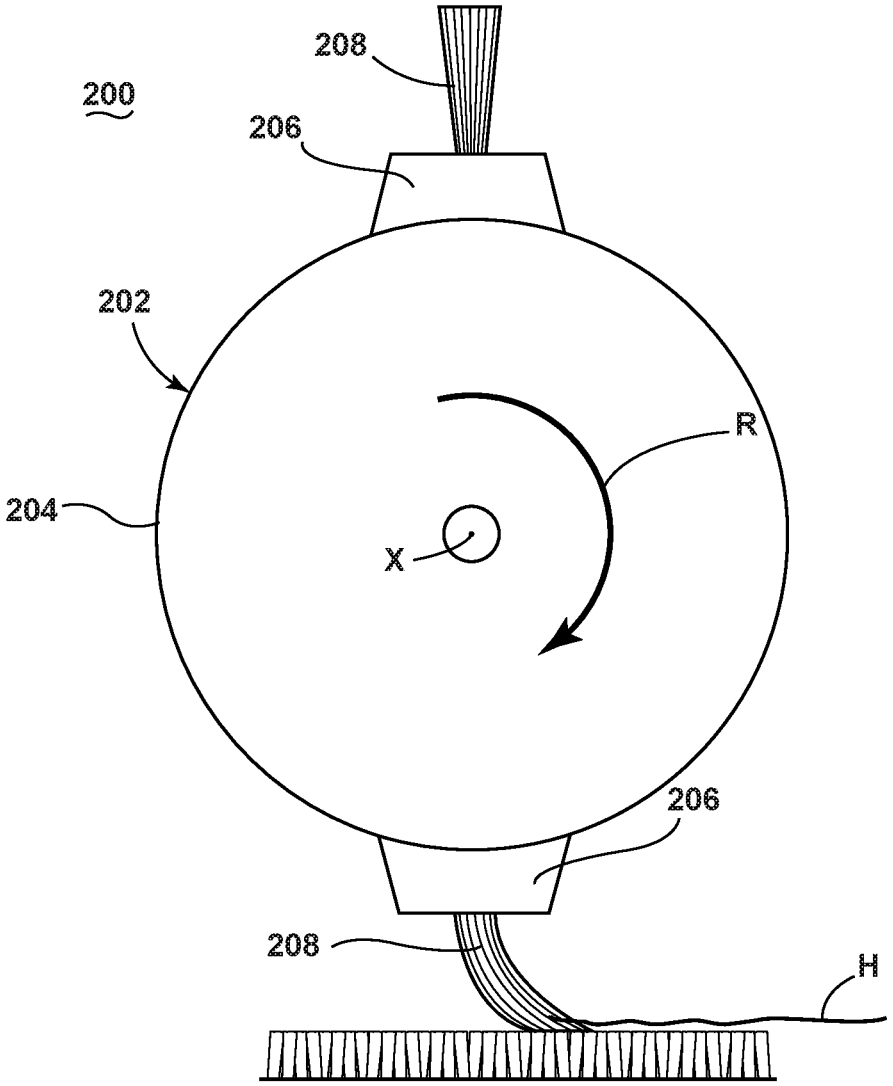
FIG. 1 is a schematic cross section of a conventional brushroll for a vacuum cleaner.

FIG. 1 is a schematic cross section of a conventional brushroll 200 for a vacuum cleaner. The brushroll 200 includes a brush dowel 202 configured to be mounted for rotation about a central rotational axis X extending longitudinally through the dowel 202. The dowel 202 includes a cylindrical core 204 and one or more bristle supports 206 projecting from the core 204. A plurality of bristles 208 protrude from the bristle supports 206; the bristles 208 can be provided in a series of discrete tufts or in a continuous strip. The bristles 208 can be arranged in various patterns on the dowel, including straight, angled, helical, or combinations thereof.

Figure 2:
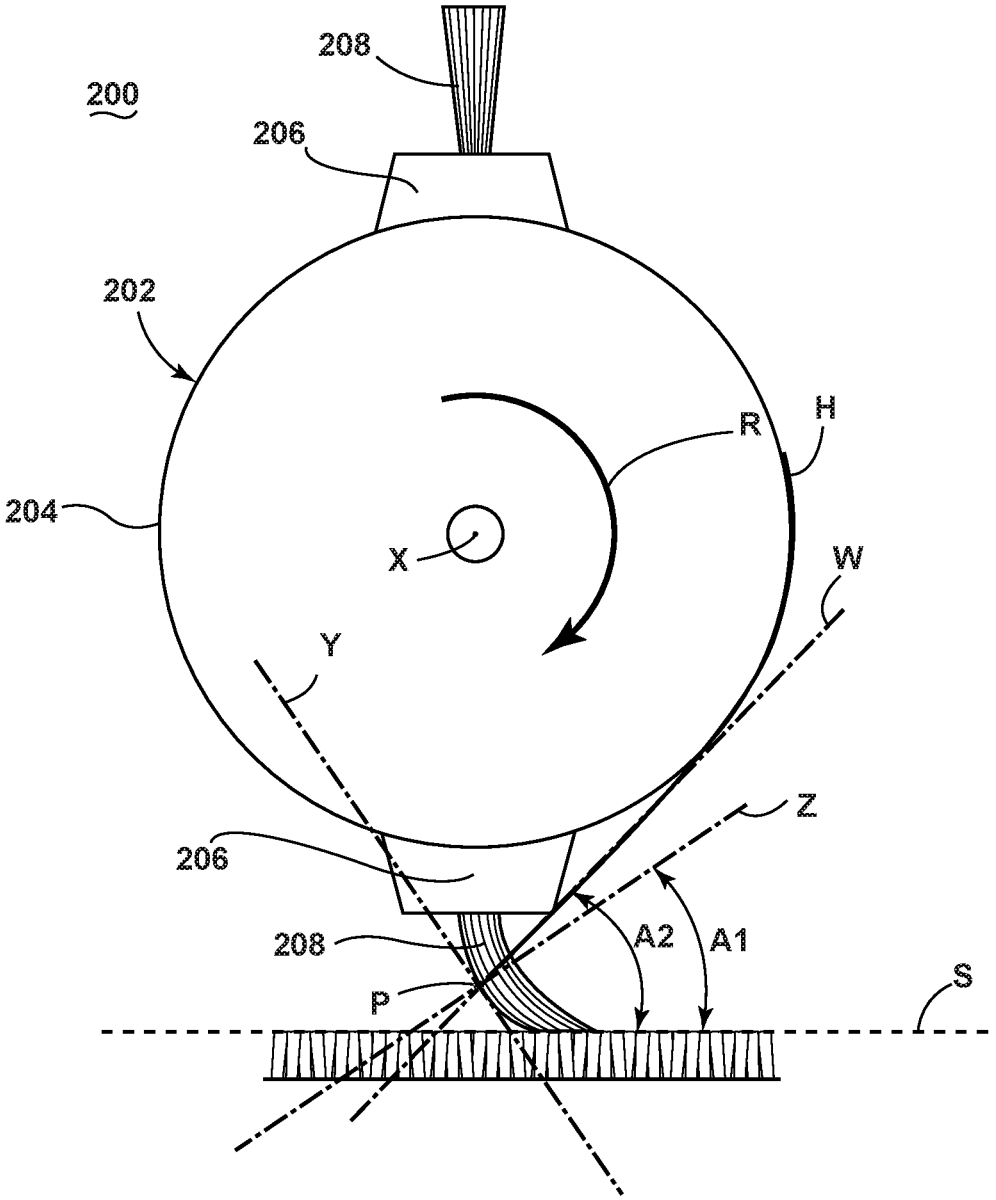
FIG. 2 is a view similar to FIG. 1 showing the brushroll during operation.

FIGS. 1-2 show an exemplary operation of the brushroll 200. During operation, the brushroll 200 is configured to be rotationally driven in the direction indicated by arrow R. As the bristles 208 come into contact with the surface to be cleaned, the bristles 208 are deflected. Debris, which can include, but is not limited to, dirt, dust, and hair, on the surface to be cleaned is swept up by the brushroll 200. In the present example, for purposes of simple illustration, a single hair H on the surface is shown as being picked up by the brushroll 200 in FIG. 1 by the bristles 208 in contact with the surface. The bristles 208 lift the hair H off the surface and around the dowel 202 as the brushroll 200 rotates.

In some cases, the hair H may be pulled off the bristles 208 by the suction force of the vacuum cleaner. In other cases, as the bristles 208 holding the hair H continue along the rotational path determined by the dowel 202, the hair H can become wrapped around the dowel 202, as shown in FIG. 2.

As the bristles 208 holding the hair H again come into contact with the surface to be cleaned, the hair H extends from an attachment point P, which is where at least one strand of hair H is attached to at least one bristle 208. When viewed from the side, the surface to be cleaned defines a surface line S, and the deflected bristles 208 define a bristle deflection line Y, which is the tangent line to the curve defined by the deflected bristles 208 at the attachment point P. A deflection angle A1 is defined by the included angle formed by the surface line S and a line Z, which is the line orthogonal to the bristle deflection line Y at the intersection of the bristle deflection line Y with the surface line S. The hair H defines a hair wrap line W, which is the line defined by the hair H from the attachment point P where it extends from or leaves the bristles 208. In some cases, the portion of the hair H extending immediately from the bristles 208 may extend substantially linearly before curving around the dowel 202, and so that hair wrap line W can follow that linear portion of the hair H. A hair wrap angle A2 is defined by the included angle formed by the surface line S and the hair wrap line W. It is noted that the hair H can be caught in various locations by the bristles 208, but that, regardless of where the hair is attached to the bristles, the wrapped hair H will have at least some portion that extends from the bristles 208 in the direction opposite to brushroll rotation R.

It has been found that for brushroll designs where the hair wrap angle A2 is greater than the deflection angle A1 (in other words, where A2>A1), the hair is pulled toward the root of the bristles 208 and becomes tightly wrapped around the dowel 202. In this case, the hair cannot be pulled off the brushroll 200 by the suction force of the vacuum cleaner, and the user must manually remove the hair.

Embodiments of the present invention include brushroll designs in which the hair wrap angle A2 is less than or equal to the deflection angle A1 (in other words, where A2≤A1). Such brushrolls prevent or greatly reduce the amount of hair wrap during operation.

Figure 3:
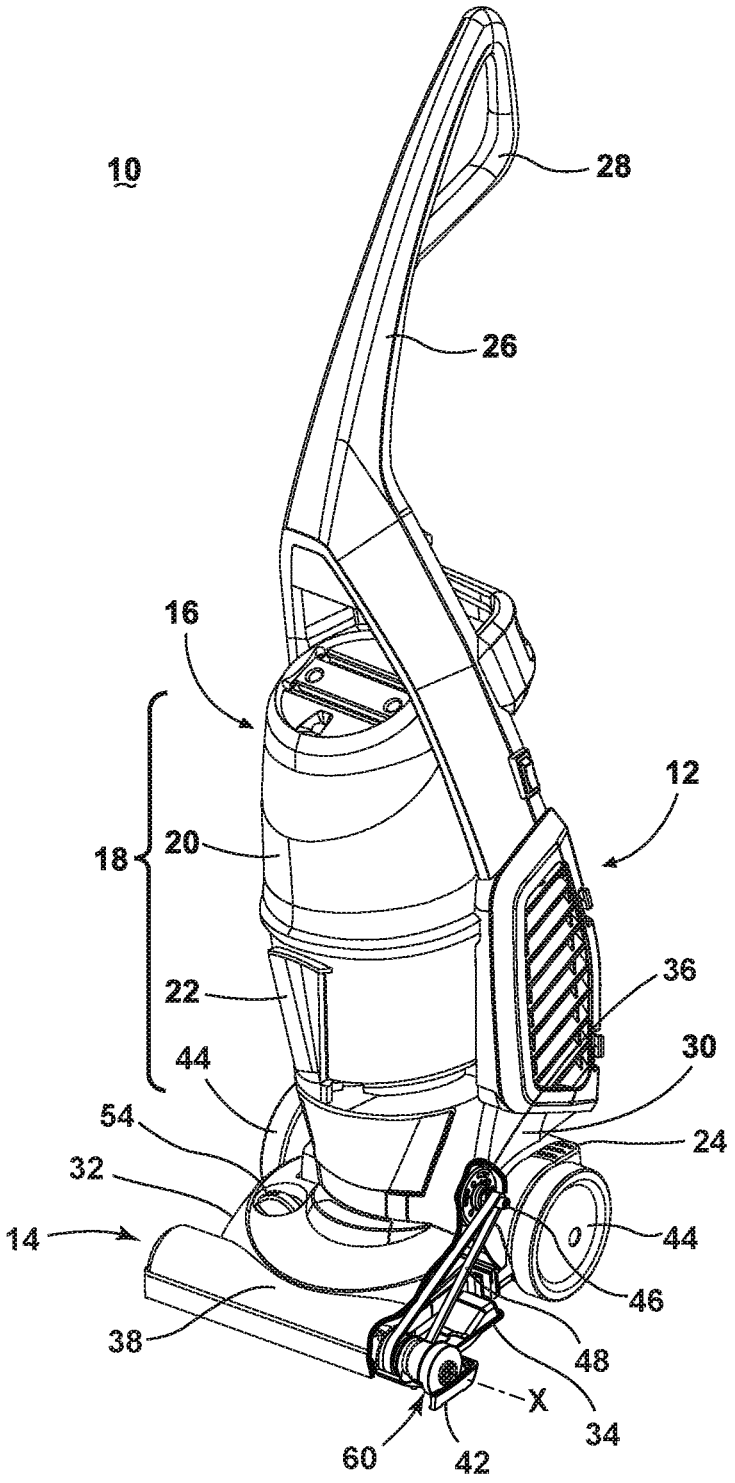
FIG. 3 is a perspective view of a vacuum cleaner according to a first embodiment of the invention, with a portion cut away for clarity.

FIG. 3 is a perspective view of a vacuum cleaner 10 in the form of an upright vacuum cleaner according to a first embodiment of the invention. While shown and referred to herein as an upright vacuum cleaner, the vacuum cleaner 10 can alternatively be configured as a stick vacuum cleaner, an autonomous or robotic vacuum cleaner, a hand-held vacuum cleaning device, or as an apparatus having a floor nozzle or a hand-held accessory tool connected to a canister or other portable device by a vacuum hose. Additionally, the vacuum cleaner 10 can be configured to have fluid distribution capability and/or extraction capability.

For purposes of description related to the figures, the terms "upper," "lower," "right," "left," "rear," "front," "vertical," "horizontal," and derivatives thereof shall relate to the invention as oriented in FIG. 3 from the perspective of a user behind the vacuum cleaner, which defines the rear of the vacuum cleaner. However, it is to be understood that the invention may assume various alternative orientations, except where expressly specified to the contrary.

As illustrated, the vacuum cleaner 10 comprises an upright body 12 pivotally mounted to a lower base 14. The upright body 12 generally comprises a main support section 16 supporting a collection system 18 for separating and collecting contaminants from a working airstream for later disposal. In one conventional arrangement illustrated herein, the collection system 18 can include a cyclone separator 20 for separating contaminants from a working airstream and a removable dirt cup 22 for receiving and collecting the separated contaminants from the cyclone separator 20. The cyclone separator 20 can have a single cyclonic separation stage, or multiple stages. In another conventional arrangement, the collection system 18 can include an integrally formed cyclone separator and dirt cup, with the dirt cup being provided with a bottom-opening dirt door for contaminant disposal. It is understood that other types of collection systems 18 can be used, such as centrifugal separators or bulk separators. In yet another conventional arrangement, the collection system 18 can include a filter bag. The vacuum cleaner 10 can also be provided with one or more additional filters upstream or downstream of the collection system 18.

The upright body 12 is pivotally mounted to the base 14 for movement between an upright storage position, shown in FIG. 3, and a reclined use position (not shown). The vacuum cleaner 10 can be provided with a detent mechanism, such as a pedal 24 pivotally mounted to the base 14, for selectively releasing the upright body 12 from the storage position to the use position. The details of such a detent pedal 24 are known in the art, and will not be discussed in further detail herein.

The upright body 12 also has an elongated handle 26 extending upwardly from the main support section 16 that is provided with a hand grip 28 at one end that can be used for maneuvering the vacuum cleaner 10 over a surface to be cleaned. A motor cavity 30 is formed at a lower end of the support section 16 and contains a conventional suction source, such as a motor/fan assembly 36, positioned therein in fluid communication with the collection system 18. The vacuum cleaner 10 can also be provided with one or more additional filters upstream or downstream of motor/fan assembly.

In FIG. 3, a lower portion of the vacuum cleaner 10 is cut away to show features of the base 14. The base 14 can include an upper housing 32 that couples with a lower housing 34 to create a partially enclosed space therebetween. An agitator chamber 38 can be provided at a forward portion of the lower housing 34 for receiving a brushroll 60. A suction nozzle opening 42 is formed in the lower housing 34 and is in fluid communication with the agitator chamber 38 and the collection system 18. Wheels 44 can be provided on the base 14 for maneuvering the vacuum cleaner 10 over a surface to be cleaned.

The brushroll 60 is positioned within the agitator chamber 38 for rotational movement about a central rotational axis X. A single brushroll 60 is illustrated; however, it is within the scope of the invention for dual rotating brushrolls to be used. Moreover, it is within the scope of the invention for the brushroll 60 to be mounted within the agitator chamber 38 in a fixed or floating vertical position relative to the chamber 38 and lower housing 34.

The brushroll 60 can be operably coupled to and driven by the motor/fan assembly 36 in the motor cavity 30. The motor/fan assembly 36 can comprise a motor shaft 46 which is oriented substantially parallel to the surface to be cleaned and protrudes from the motor cavity 30 into a rear portion of the base 14. A drive belt 48 operably connects the motor shaft 46 to the brushroll 60 for transmitting rotational motion of the motor shaft 46 to the brushroll 60. Alternatively, a separate, dedicated agitator drive motor (not shown) can be provided within the base 14 to drive the brushroll 60.

The base 14 can further include an optional suction nozzle height adjustment mechanism for adjusting the height of the suction nozzle opening 42 with respect to the surface to be cleaned. A rotatable knob 54 for actuating the adjustment mechanism can be provided on the exterior of the base 14. In another variation, the suction nozzle height adjustment mechanism can be eliminated.

In operation, the vacuum cleaner 10 draws in debris-laden air through the base 14 and into the collection system 18 where the debris, which can include, but is not limited to, dirt, dust, hair, and other debris, is substantially separated from the working air flow, which is generated by the motor/fan assembly 36. The spinning motor shaft 46 of the motor/fan assembly 36 rotates the brushroll 60 via the drive belt 48 that is operably connected therebetween. Alternatively, a separate, dedicated agitator drive motor can rotate the brushroll 60. As the brushroll 60 rotates, the bristles sweep across the surface to be cleaned to release and propel debris into the working air flow generated by the motor/fan assembly 36, which carries the debris into the collection system 18. The working air flow then passes through the motor cavity 30 and past the motor/fan assembly 36 prior to being exhausted from the vacuum cleaner 10. The collection system 18 can be periodically emptied of debris.

Figure 4:
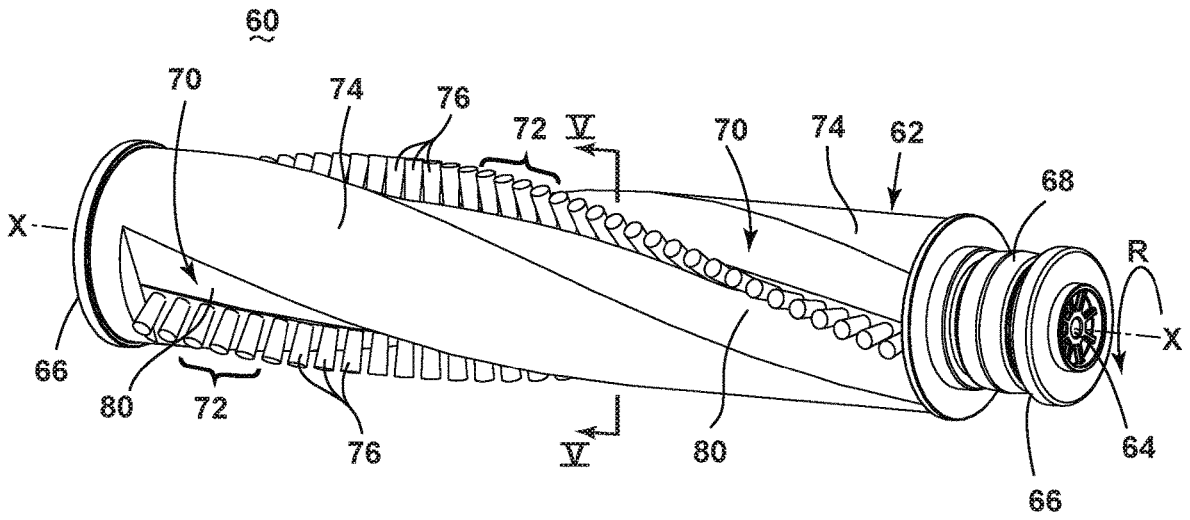
FIG. 4 is a perspective view of a brushroll for the vacuum cleaner of FIG. 3.

FIG. 4 is a perspective view of the brushroll 60. The brushroll 60 includes a brush dowel 62 configured to be mounted for rotation about a central rotational axis X extending longitudinally through the dowel 62. The brush dowel 62 is mounted on an elongated shaft 64 that extends through the center of the dowel 62 and defines the central rotational axis X around which the brushroll 60 rotates. The brushroll 60 illustrated is configured to be rotationally driven in the direction indicated by arrow R. A bearing 66 is mounted on each end of the shaft 64. In operation, the dowel 62 rotates about the shaft 64 on the bearings 66. A belt engagement surface 68 extends around the circumference of the dowel 62 near one end, and communicates with the belt 48 (FIG. 3). The belt engagement surface 68 may comprise a pulley.

The brush dowel 62 further includes one or more bristle supports 70 which project into the dowel 62. Bristles 72 protrude from the bristle supports 70, and can be provided in a series of discrete tufts or in a continuous strip. The bristles 72 can be arranged in various patterns on the dowel 62, including straight, angled, helical, or combinations thereof.

The brushroll 60 is designed to prevent or greatly reduce the amount of hair wrap during operation by providing a shroud surface 74 for wrapping hair. The shroud surface 74 is provided adjacent to the bristles 72 in order to establish a more shallow hair wrap angle, as described in further detail below.

In the illustrated embodiment, two bristle supports 70 and two corresponding rows of bristle tufts 76 are provided on the dowel 62, each tuft 76 containing a plurality of bristles 72, and extend in a generally helical pattern around the circumference of the dowel 62. The outer surface of the brush dowel 62 includes opposing curved sections, shown herein as convex curved surfaces 86, defining the shroud surface 74 and opposing flat sections defining mounting surfaces 78 of the bristle supports 70 from which the tufts 76 project.

Figure 5:
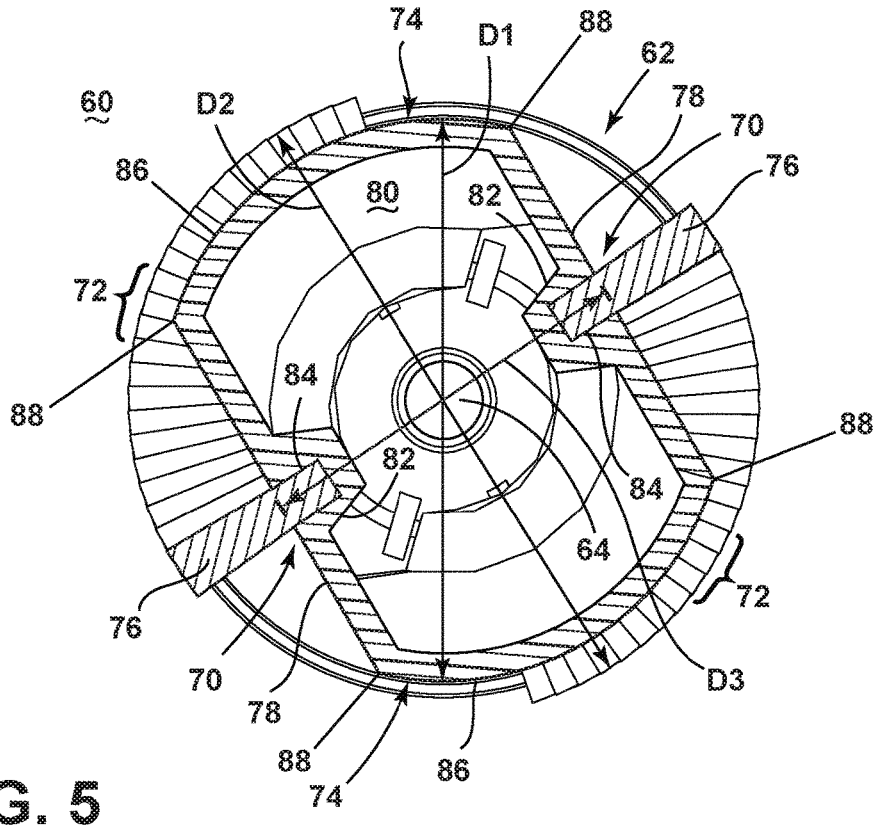
FIG. 5 is a cross-sectional view of the brushroll taken through line V-V of FIG. 4.

FIG. 5 is a cross section of the brushroll 60 taken through line V-V of FIG. 4. The brush dowel 62 can define a hollow interior 80 that extends along the length of the dowel 62. The shaft 64 is received within the hollow interior 80. The bristle supports 70 further include bristle support platforms 82 which project from the mounting surfaces 78 into the hollow interior 80 of the dowel 62. Bristle holes 84 for the bristle tufts 76 can be formed in the mounting surface 78 and can extend at least partially into the platforms 82.

In one non-limiting example, to produce the brushroll 60 shown in FIG. 5, the outer contour of the dowel 62 can be formed using a two-part mold, while the interior of the dowel 62, including the platforms 82, can be cored out using an unscrewing core. It is noted that, in order to form the brushroll 60 in a two-part mold, the bristle supports 70 and shroud surfaces 74 may extend 180 degrees or less along the length of the dowel 62 in order to be in the line of draw. The bristle holes 84 can be formed in the dowel 62 by drilling into the dowel 62 after molding, or can be integrally molded with the dowel 62. The bristle tufts 76 can be assembled with the dowel 62 by pressing bristles 72 into the bristle holes 84 and securing the bristles 72 using a fastener (not shown), such as, but not limited to, a staple, wedge, or anchor. The dowel 62 can comprise a polymeric material, such as polypropylene, acrylonitrile butadiene styrene (ABS), or styrene. The bristles 72 can comprise a polymeric material, such as nylon or polyester, for example, which allows the bristles 72 to flex and deflect when brought into contact with a surface to be cleaned during normal operation. Other manufacturing methods can also be used to produce the brushroll 60 shown in FIG. 5.

As noted above, the brushroll 60 is designed to prevent or greatly reduce the amount of hair wrap during operation by providing the shroud surface 74 for wrapping hair. In the illustrated embodiment, the brush dowel 62 defines a major diameter D1, which is the diameter defined by the smallest circle that can enclose the shroud surface 74 of the dowel 62. The bristle tufts 76 define a trim diameter D2, which is slightly larger than the major diameter D1. The flat mounting surfaces 78 are recessed below the major diameter D1, and therefore below the shroud surface 74, which allows the bristles 72 on the flat mounting surfaces 78 to deflect when contacting the surface to be cleaned, while keeping any hair at or near the tip of the bristles 72. For example, the bristle supports 70 define a minor diameter D3 of the brush dowel 62. The minor diameter D3 can be defined at the tufting locations of the bristle tufts 76 in the bristle supports 70. The minor diameter D3 can be less than the major diameter D1 and the trim diameter D2. In the illustrated example, the minor diameter D3 is the diameter defined by the smallest circle that can touch both mounting surfaces 78 of the bristle supports 70, at the tufting locations of the bristle tufts 76. Other configurations for a brushroll having bristle supports 70 and shroud surface 74 may have major and minor diameters D1, D3 defined in other manners, as long as the shroud surface 74 defines D1 and the bristle supports 70 define D3.

The outer surface of the brush dowel 62 shown in FIG. 5 further includes outside corners 88 where the convex curved surfaces 86 defining the shroud surface 74 intersect the opposing flat sections defining mounting surfaces 78. The outside corners 148 are where the two converging surfaces 78, 86 meet. Further, the brush dowel 62 shown in FIG. 5 is symmetrical about multiple axes, including a first axis of symmetry extending generally along where the minor diameter D3 is defined, and second axis of symmetry that is orthogonal to the first axis of symmetry, generally where the trim diameter D2 is shown in FIG. 5.

Figure 6:
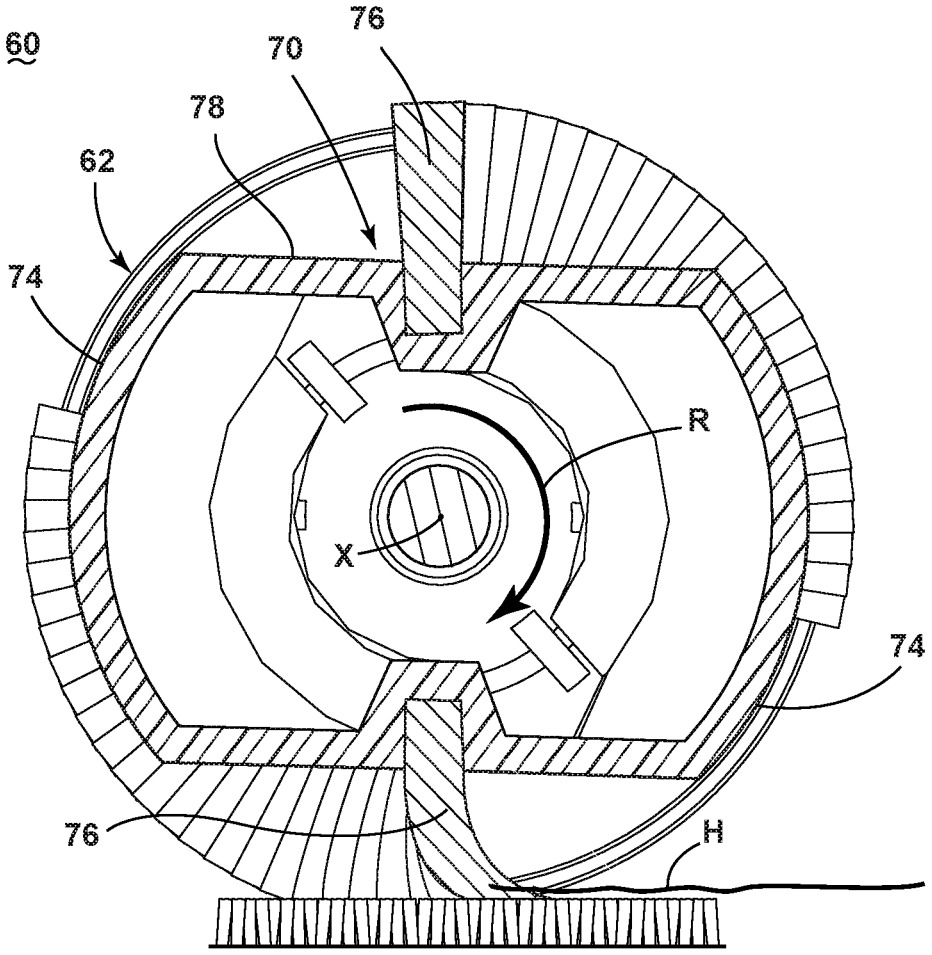
FIGS. 6-7 are views similar to FIG. 5 showing the brushroll during operation.
Figure 7:
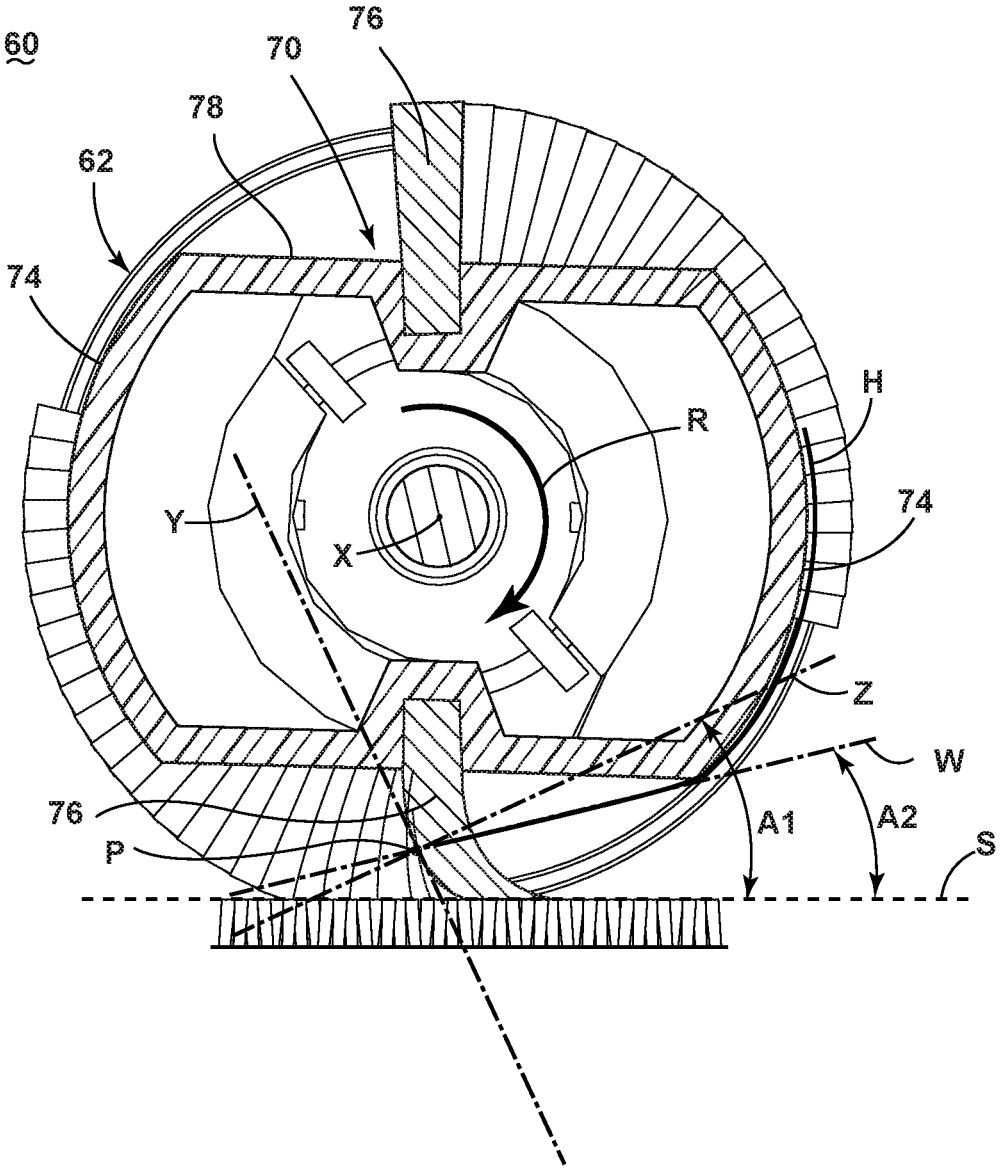

FIGS. 6-7 show an exemplary operation of the brushroll 60. The brushroll 60 is designed to have a hair wrap angle A2 that is less than or equal to the deflection angle A1 (in other words, where A2≤A1). During operation, the brushroll 60 rotates in direction R and debris including, but not limited to, dirt, dust, and hair on the surface to be cleaned is swept up by the brushroll 60. In the present example, for purposes of simple illustration, a single hair H on the surface is shown as being picked up by the brushroll 60 in FIG. 6 by the bristle tuft 76 in contact with the surface. The bristle tuft 76 lifts the hair H off the surface and around the dowel 62 as the brushroll 60 rotates. In some cases, the hair H may be pulled off the brushroll 60 by the suction force of the vacuum cleaner. In other cases, as the bristle tuft 76 holding the hair H continues along the rotational path determined by the dowel 62, the hair H can wrap around the shroud surface 74, as shown in FIG. 7, extending from the attachment point P to the bristle tuft 76 and around the dowel 62. Because the hair wrap angle A2 is more shallow, the hair H remains at or near the tip of the bristle tuft 76 and the hair H is not pulled toward the root of the bristles 208, nor does the hair H wrap tightly around the dowel 62. As the bristle tuft 76 holding the hair H again comes into contact with the surface to be cleaned, the hair H can be pulled off the bristle tuft 76 by frictional contact with the surface to be cleaned and the resulting deflection of the bristle tuft 76. Though the hair H may be returned to the surface, as the vacuum cleaning operation continues, the same hair H may be picked up again by the brushroll 60 and pulled off the brushroll 60 by the suction force of the vacuum cleaner. It is also noted that the brushroll 60 may make one or more revolutions before hair H is pulled off the brushroll 60 by suction force or releasing hair back onto the surface to be cleaned.

In one example, the hair wrap angle A2 of the brushroll 60 can be approximately half of the bristle deflection angle A1. Keeping the minor diameter D3 less than the major diameter D1 essentially pulls the bristle tips in closer to the shroud surface 74, such that the trim diameter D2 remains slightly larger than the major diameter D1, and hair wrap can be prevented. If the hair wrap angle A2 becomes too shallow, essentially by the major diameter D1 of the shroud surface 74 becoming larger relative to the trim diameter D2, the shroud surface 74 may prevent the bristle tufts 76 from engaging the surface to be cleaned.

Figure 8:
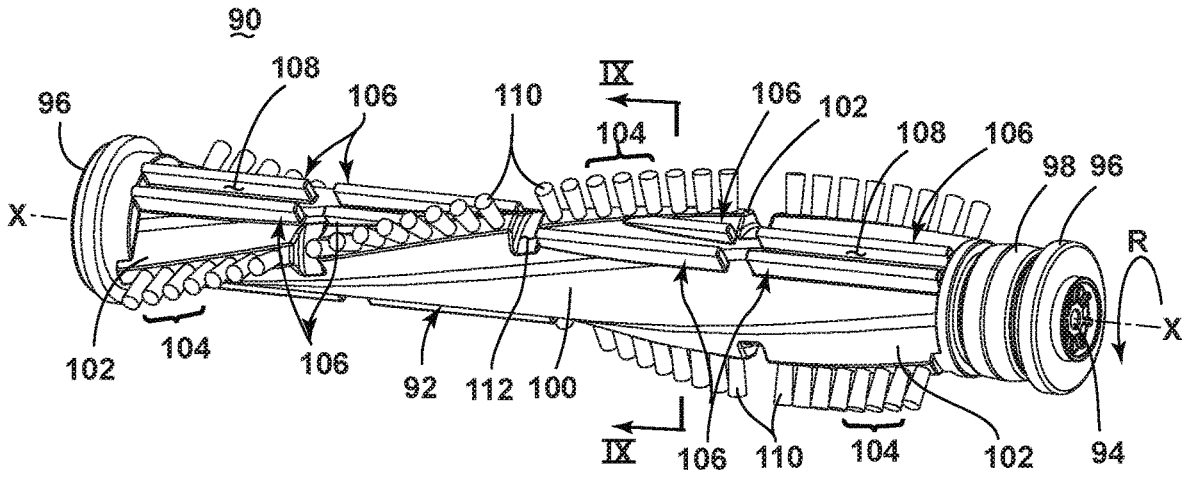
FIG. 8 is a perspective view of a brushroll according to a second embodiment of the invention.

FIG. 8 is a perspective view of a brushroll 90 according to a second embodiment of the invention. The brushroll 90 can be used with the vacuum cleaner 10 of FIG. 3, as described above, or with other vacuum cleaners and accessory tools, and is designed to accommodate a secondary device for cutting wrapped hair. In one embodiment the secondary device includes scissors or another hand-held cutting implement. The brushroll 90 includes a brush dowel 92 configured to be mounted for rotation about a central rotational axis X extending longitudinally through the dowel 92. The brush dowel 92 is mounted on an elongated shaft 94 that extends through the center of the dowel 92 and defines the central rotational axis X around which the brushroll 90 rotates. The brushroll 90 illustrated is configured to be rotationally driven in the direction indicated by arrow R. A bearing 96 is mounted on each end of the shaft 94. In operation, the dowel 92 rotates about the shaft 94 on the bearings 96. A belt engagement surface 98 extends around the circumference of the dowel 92 near one end, and can communicate with a belt, such as belt 48 (FIG. 3). The belt engagement surface 98 may comprise a pulley.

The brush dowel 92 further includes a cylindrical core 100 and one or more bristle supports 102 projecting from the core 100. Bristles 104 protrude from the bristle supports 102, and can be provided in a series of discrete tufts or in a continuous strip. The bristles 104 can be arranged in various patterns on the dowel 92, including straight, angled, helical, or combinations thereof.

The brushroll 90 is designed to accommodate a secondary device for cutting wrapped hair by providing at least one standing rib 106 adjacent to the bristles 104 which defines a channel 108 into which scissors or another cutting implement can be inserted to cut hair that is wrapped around the dowel 92.

In the illustrated embodiment, two rows of bristle supports 102 and two corresponding rows of bristle tufts 110, each tuft 110 containing a plurality of bristles 104, are provided on the dowel 92. The rows extend in a generally helical pattern around the circumference of the dowel 92. Further, two opposing sets of standing ribs 106 project radially from the dowel 92, though only one set of visible in FIG. 8. The ribs 106 can extend axially along the core 100 of the dowel 92 in one or more rows to define the channel 108. Alternatively, the channel 108 can be formed between one standing rib 106 and the bristle support 102.

Circumferential gaps 112 can extend around the dowel 92 to separate adjacent bristle supports 102 and ribs 106, and further allow the rotating brushroll 90 to clear ribs on the lower housing 34 that prevent carpet from getting drawn into the suction nozzle opening 42 (FIG. 4).

Figure 9:
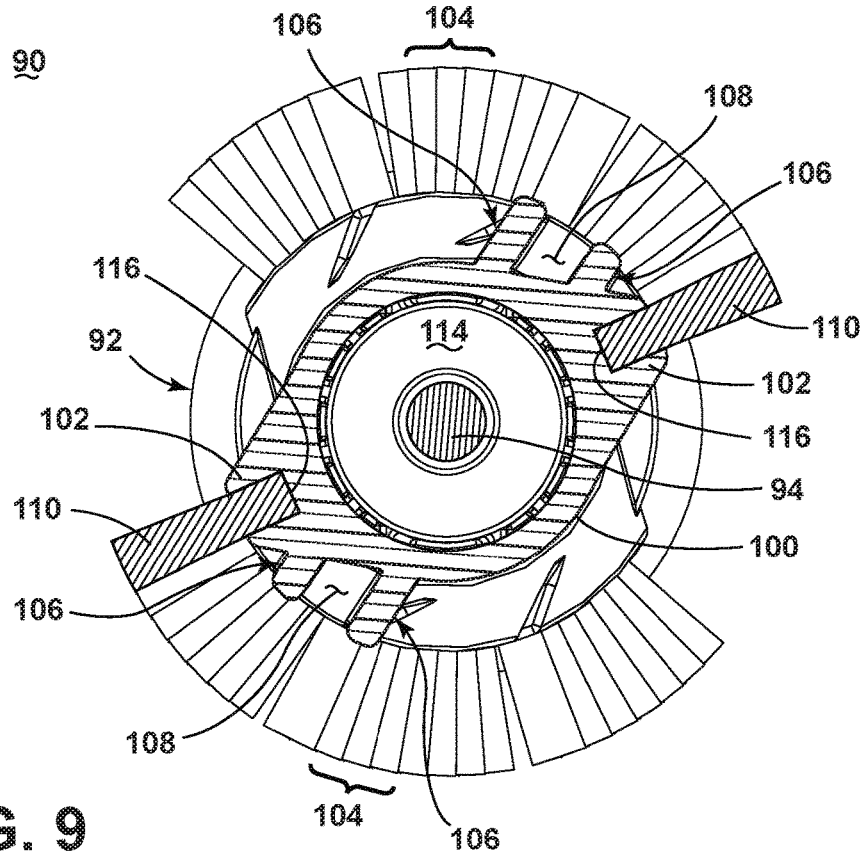
FIG. 9 is a cross-sectional view of the brushroll taken through line IX-IX of FIG. 8.

FIG. 9 is a cross section of the brushroll 90 taken through line IX-IX of FIG. 8. The brush dowel 92 can define a hollow interior 114 that extends along the length of the dowel 92. The shaft 94 is received within the hollow interior 114. Bristle holes 116 for the bristle tufts 110 can be formed in the bristle supports 102.

In one non-limiting example, to produce the brushroll 90 shown in FIG. 9, the outer contour of the dowel 92, including the bristle supports 102 and the ribs 106, can be formed using a two-part mold, while the interior of the dowel 92 can be cored out using an unscrewing core. The ribs 106 are oriented in the line of draw. The bristle holes 116 can be formed in the dowel 92 by drilling into the dowel 92 after molding, or can be integrally molded with the dowel 92. The bristle tufts 110 can be assembled with the dowel 92 by pressing bristles 104 into the bristle holes 116 and securing the bristles 104 using a fastener (not shown), such as, but not limited to, a staple, wedge, or anchor. The dowel 92 can comprise a polymeric material, such as polypropylene, ABS, or styrene. The bristles 104 can comprise a polymeric material, such as nylon or polyester, for example, which allows the bristles 104 to flex and deflect when brought into contact with a surface to be cleaned during normal operation. Other manufacturing methods can also be used to produce the brushroll 90 shown in FIG. 9.

During operation, the brushroll 90 rotates in direction R and debris including, but not limited to, dirt, dust, and hair on the surface to be cleaned is swept up by the brushroll 90. In some cases, hair can wrap around the dowel 92 rather than being pulled off the brushroll 90 by suction force of the vacuum cleaner. In this case, scissors or another cutting implement can be inserted into the channel 108 defined by the ribs 106 to cut that hair that is wrapped around the dowel 92.

In a further embodiment, the height of the standing ribs 106 can be increased so that the outer perimeter defined by the top of the standing ribs 106 forms a shroud surface to minimize the hair wrap angle A2, as described for the first embodiment.

It should be understood that the brushroll 60 of FIGS. 4-7 can further be designed to accommodate a secondary device, such as scissors or another hand-held cutting implement, for cutting wrapped hair in a manner similar to the brushroll 90 of FIGS. 8-9. In one embodiment, ribs 106 and/or channel 108 can be provided in the dowel 62.

Figure 10:
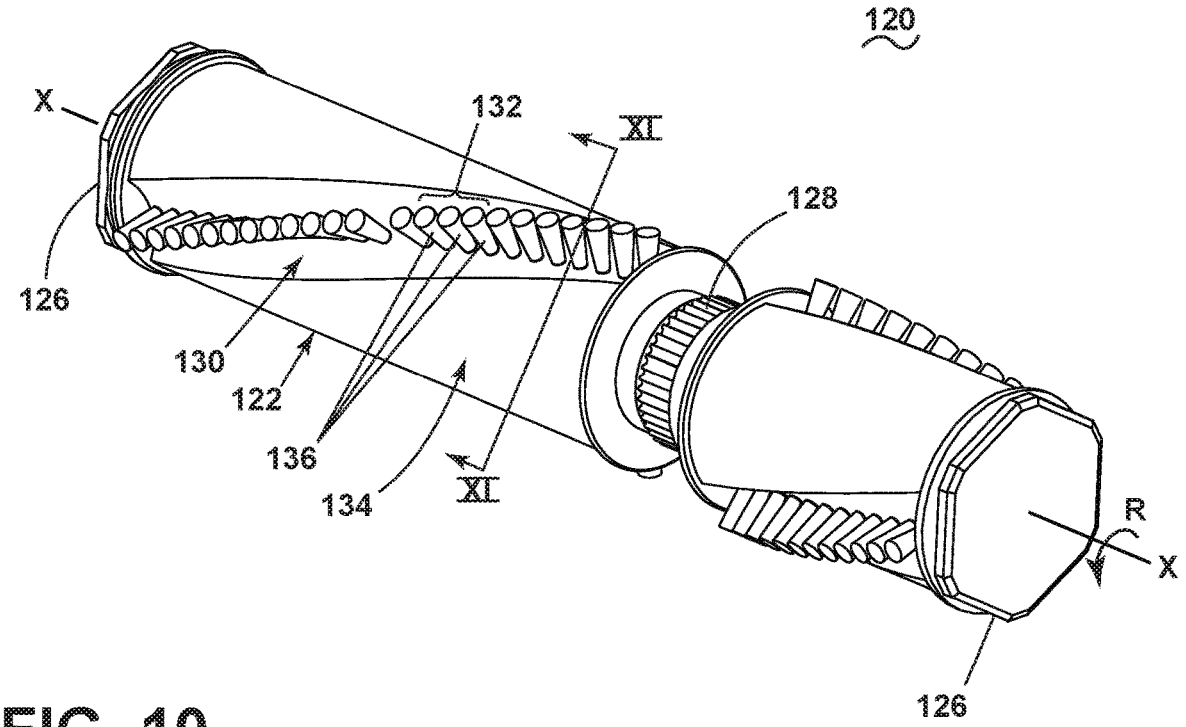
FIG. 10 is a perspective view of a brushroll according to a third embodiment of the invention.
Figure 11:
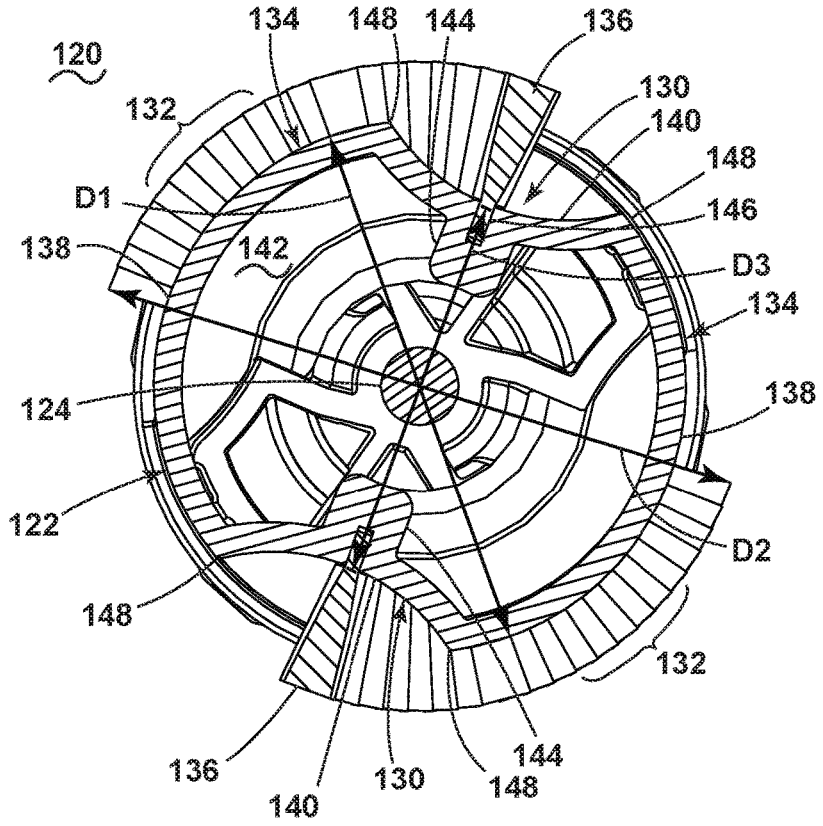
FIG. 11 is a cross-sectional view of the brushroll taken through line XI-XI of FIG. 10.

FIGS. 10-11 show a brushroll 120 according to a third embodiment of the invention. The brushroll 120 can be used with the vacuum cleaner 10 of FIG. 3, as described above, or with other vacuum cleaners and accessory tools, and differs from the first embodiment of the brushroll 60 by having concave, rather than flat, tufting surfaces, as described in further detail below.

The brushroll 120 includes a brush dowel 122 configured to be mounted for rotation about a central rotational axis X extending longitudinally through the dowel 122. The brush dowel 122 is mounted on an elongated shaft 124 that extends through the center of the dowel 122 and defines the central rotational axis X around which the brushroll 120 rotates. The brushroll 120 illustrated is configured to be rotationally driven in the direction indicated by arrow R. A bearing 126 is mounted on each end of the shaft 124. In operation, the dowel 122 rotates about the shaft 124 on the bearings 126. A belt engagement surface 128 extends around the circumference of the dowel 122 near one end, and can communicate with a belt, such as belt 48 (FIG. 3). The belt engagement surface 128 may comprise a pulley.

The brush dowel 122 further includes one or more bristle supports 130 which project into the dowel 122. Bristles 132 protrude from the bristle supports 130, and can be provided in a series of discrete tufts or in a continuous strip. The bristles 132 can be arranged in various patterns on the dowel 122, including straight, angled, helical, or combinations thereof.

The brushroll 120 is designed to prevent or greatly reduce the amount of hair wrap during operation by providing a shroud surface 134 for wrapping hair. The shroud surface 134 is provided adjacent to the bristles 132 in order to establish a more shallow hair wrap angle, the benefits of which are discussed above with respect to the first embodiment of the brushroll 60.

In the illustrated embodiment, two bristle supports 130 and two corresponding rows of bristle tufts 136 are provided on the dowel 122, each tuft 136 containing a plurality of bristles 132, and extend in a generally helical pattern around the circumference of the dowel 122. The overall outer surface of the brush dowel 122 includes opposing convex curved surfaces 138 which together define the shroud surface 134 and opposing concave curved surfaces 140 defining mounting surfaces of the bristle supports 130 from which the tufts 136 project.

FIG. 11 is a cross section of the brushroll 120 taken through line XI-XI of FIG. 10. The brush dowel 122 can define a hollow interior 142 that extends along the length of the dowel 122. The shaft 124 is received within the hollow interior 142. The bristle supports 130 further include bristle support platforms 144 which project from the concave curved surfaces 140 into the hollow interior 142 of the dowel 122. Bristle holes 146 for the bristle tufts 136 can be formed in the concave curved surfaces 140 and can extend at least partially into the platforms 144.

In one non-limiting example, to produce the brushroll 120 shown in FIGS. 10-11, the outer contour of the dowel 122 can be formed using a two-part mold, while the interior of the dowel 122, including the platforms 144, can be cored out using an unscrewing core. It is noted that, in order to form the brushroll 120 in a two-part mold, the bristle supports 130 and shroud surfaces 134 may extend 180 degrees or less along the length of the dowel 122 in order to be in the line of draw. The bristle holes 146 can be formed in the dowel 122 by drilling into the dowel 122 after molding, or can be integrally molded with the dowel 122. The bristle tufts 136 can be assembled with the dowel 122 by pressing bristles 132 into the bristle holes 146 and securing the bristles 132 using a fastener (not shown), such as, but not limited to, a staple, wedge, or anchor. The dowel 122 can comprise a polymeric material, such as polypropylene, acrylonitrile butadiene styrene (ABS), or styrene, for example. The bristles 132 can comprise a polymeric material, such as nylon or polyester, for example, which allows the bristles 132 to flex and deflect when brought into contact with a surface to be cleaned during normal operation. Other manufacturing methods can also be used to produce the brushroll 120 shown in FIGS. 10-11.

The concave curved surfaces 140 intersect the convex shroud surfaces 138 at outside corners 148 where the two converging surfaces 138, 140 meet. Further, the brush dowel 122 shown in FIG. 11 is symmetrical about multiple axes, including a first axis of symmetry extending generally along where the minor diameter D3 is defined, and second axis of symmetry that is orthogonal to the first axis of symmetry, generally where the trim diameter D2 is shown in FIG. 11.

As noted above, the brushroll 120 is designed to prevent or greatly reduce the amount of hair wrap during operation by providing the shroud surface 134 for wrapping hair. For example, the concave curved surfaces 140 are recessed below the major diameter D1, and therefore below the shroud surface 134, which allows the bristles 132 on the concave curved surfaces 140 to deflect when contacting the surface to be cleaned, while keeping any hair at or near the tip of the bristles 132.

In the illustrated embodiment, the brushroll 120 further includes bristle supports 130 that are defined by concave curved surfaces 140, rather than flat surfaces 78 as for the first embodiment of the brushroll 60 (FIG. 5). Having concave curved surfaces 140 defining the tufting surfaces of the brushroll 120, i.e. the surfaces to which the bristle tufts 136 are mounted or secured, can offer improved hair wrap reduction. The concave curved surfaces 140 intersect the convex shroud surfaces 138 at outside corners 148, shown herein as raised edges 148 which can prevent hair from being wedged at the base of the bristles tufts 136. With a flat mounting surface, hair may be pulled tight across the mounting surface and toward or to the base of the bristle tuft. However, with the concave curved surfaces 140 defining trough-shaped tufting surfaces prevent hair from being wedged at the base of the tufts 136 because the hair bridging the raised edges 148 create a gap that spaces the hair from the base of the tufts 136. For the purposes of this description, the term concave curved surface refers to a surface that curves inwardly toward the central rotational axis X, forming a tufting surface that is recessed from the outside corners 148. Although the concave curved surfaces 140 are shown in the figures symmetric incurvate shapes, non-uniform and non-symmetric inwardly curved recesses are also contemplated. Additionally, non-arcuate recesses are also contemplated, such as planar tufting surfaces or V-shaped tufting surfaces, which are recessed inwardly toward the central rotational axis X, for example.

The illustrated embodiment of the brushroll 120 further has the bristle tufts 136 positioned equidistant from the raised edges 148, and projecting radially from the dowel 122 at a midpoint of the concave curved surfaces 140.

It should be understood that the brushroll 120 of FIGS. 10-11 can further be designed to accommodate a secondary device, such as scissors or another hand-held cutting implement, for cutting wrapped hair in a manner similar to the brushroll 90 of FIGS. 8-9. In one embodiment, ribs 106 and/or channel 108 can be provided in the dowel 122.

Figure 12:
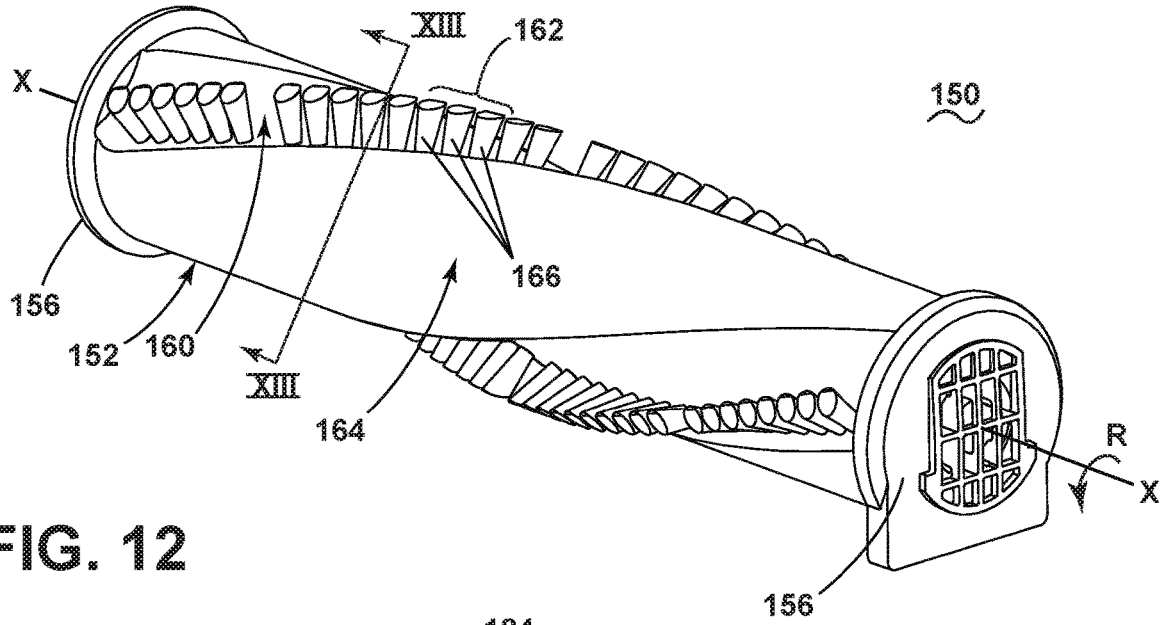
FIG. 12 is a perspective view of a brushroll according to a fourth embodiment of the invention.
Figure 13:
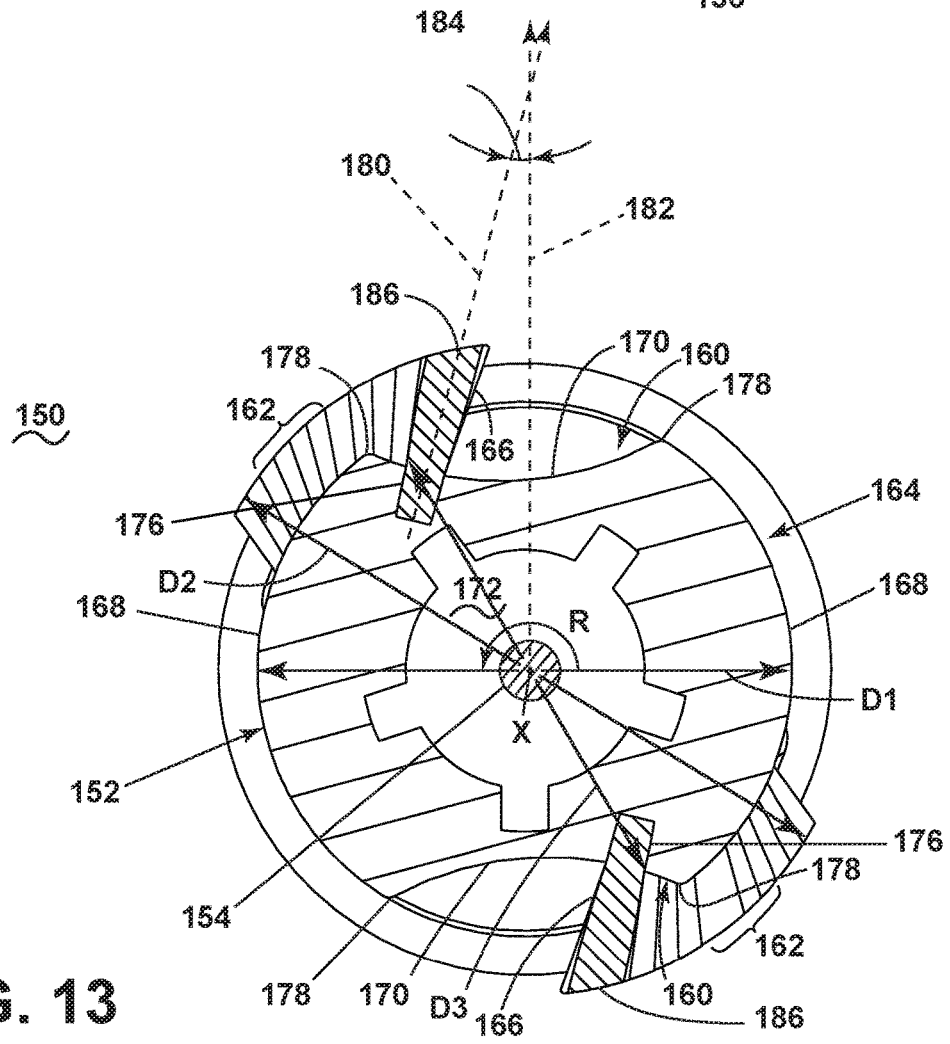
FIG. 13 is a cross-sectional view of the brushroll taken through line XIII-XIII of FIG. 12.

FIGS. 12-13 show a brushroll 150 according to a fourth embodiment of the invention. The brushroll 150 can be used with the vacuum cleaner 10 of FIG. 3, as described above, or with other vacuum cleaners and accessory tools, and differs from the third embodiment of the brushroll 120 by having offset, swept bristle tufts that are tufted at an acute angle, as described in further detail below.

The brushroll 150 includes a brush dowel 152 configured to be mounted for rotation about a central rotational axis X extending longitudinally through the dowel 152. The brush dowel 152 is mounted on an elongated shaft 154 that extends through the center of the dowel 152 and defines the central rotational axis X around which the brushroll 150 rotates. The brushroll 150 illustrated is configured to be rotationally driven in the direction indicated by arrow R. A bearing 156 is mounted on each end of the shaft 154. In operation, the dowel 152 rotates about the shaft 154 on the bearings 156. A belt engagement surface (not shown) can extend around the circumference of the dowel 152 and can communicate with a belt, such as belt 48 (FIG. 3).

The brush dowel 152 further includes one or more bristle supports 160 which project into the dowel 152. Bristles 162 protrude from the bristle supports 160, and can be provided in a series of discrete tufts or in a continuous strip. The bristles 162 can be arranged in various patterns on the dowel 152, including straight, angled, helical, or combinations thereof.

The brushroll 150 is designed to prevent or greatly reduce the amount of hair wrap during operation by providing a shroud surface 164 for wrapping hair. The shroud surface 164 is provided adjacent to the bristles 162 in order to establish a more shallow hair wrap angle, the benefits of which are discussed above with respect to the first embodiment of the brushroll 60.

In the illustrated embodiment, two bristle supports 160 and two corresponding rows of bristle tufts 166 are provided on the dowel 152, each tuft 166 containing a plurality of bristles 162, and extend in a generally helical pattern around the circumference of the dowel 152. The overall outer surface of the brush dowel 152 includes opposing convex curved surfaces 168 which together define the shroud surface 164 and opposing concave curved surfaces 170 defining mounting surfaces of the bristle supports 160 from which the tufts 166 project.

FIG. 13 is a cross section of the brushroll 150 taken through line XIII-XIII of FIG. 12. The brush dowel 152 can define a hollow interior 172 that extends along the length of the dowel 152. The shaft 154 is received within the hollow interior 172. Bristle holes 176 for the bristle tufts 166 can be formed in the concave curved surfaces 170.

In one non-limiting example, to produce the brushroll 150 shown in FIGS. 12-13, the outer contour of the dowel 152 can be formed using a two-part mold, while the interior of the dowel 152 can be cored out using an unscrewing core. It is noted that, in order to form the brushroll 150 in a two-part mold, the bristle supports 160 and shroud surfaces 164 may extend 180 degrees or less along the length of the dowel 152 in order to be in the line of draw. The bristle holes 176 can be formed in the dowel 152 by drilling into the dowel 152 after molding, or can be integrally molded with the dowel 152. The bristle tufts 166 can be assembled with the dowel 152 by pressing bristles 162 into the bristle holes 176 and securing the bristles 162 using a fastener (not shown), such as, but not limited to, a staple, wedge, or anchor. The dowel 152 can comprise a polymeric material, such as polypropylene, acrylonitrile butadiene styrene (ABS), or styrene. The bristles 162 can comprise a polymeric material, such as nylon or polyester, for example, which allows the bristles 162 to flex and deflect when brought into contact with a surface to be cleaned during normal operation. Other manufacturing methods can also be used to produce the brushroll 150 shown in FIGS. 12-13.

As noted above, the brushroll 150 is designed to prevent or greatly reduce the amount of hair wrap during operation by providing the shroud surface 164 for wrapping hair. For example, the concave curved surfaces 170 are recessed below the major diameter D1, and therefore below the shroud surface 164, which allows the bristles 162 on the concave curved surfaces 170 to deflect when contacting the surface to be cleaned, while keeping any hair at or near the tip of the bristles 162.

In the illustrated embodiment, the brushroll 150 further includes bristle supports 160 that are defined by concave curved surfaces 170 which intersect the convex shroud surfaces 168 at outside corners 178 where the two converging surfaces 168, 170 meet. The outside corners 178 are shown herein as raised edges 178, the benefits of which are discussed above with respect to the third embodiment of the brushroll 120. Still further in the illustrated embodiment, the brushroll 150 includes bristle tufts 166 that are tufted at an acute angle relative to the concave tufting surfaces 170, i.e. the tufting surfaces to which the bristle tufts 166 are mounted or secured, rather than radially 78 as for the third embodiment of the brushroll 120 (FIG. 11). In particular, the tufts 166 define and lie on a centerline axis 180 extending orthogonally through the center of the tufts 166 and the concave tufting surfaces 170 define a centerline axis 182 extending orthogonally through the center of the concave tufting surfaces 170, and the axes 180, 182 intersect outward of the dowel 152 at an acute angle 184. This provides a swept or angled tip or terminal end 186 for each tuft 166 that is angled in the direction of rotation R.

Further, the bristle tufts 166 are offset on the concave tufting surface 170, i.e. tufted closer to one edge 178 than the other, or offset from the centerline axis 182, rather than being at the center of the concave tufting surface as for the third embodiment of the brushroll 120 (FIG. 11) or equidistant from the raised edges 148. The offset, angled tufts 166 reduce the drive torque required to rotate the brushroll 150, which can be useful for particular vacuum cleaner embodiments, including autonomous or robotic vacuum cleaners. Although the bristle tufts 166 in FIGS. 12-13 are shown as both offset from the centerline axis 182, and angled relative to the concave tufting surface, other configurations are contemplated. For example, the bristle tufts 166 can be offset, but not angled, i.e. oriented parallel to the centerline axis 182. Alternatively, the bristle tufts 166 can be tufted at the centerline axis 182, i.e. not offset, but angled relative to the centerline axis instead of radial thereto as in FIGS. 10-11.

It should be understood that the brushroll 150 of FIGS. 12-13 can further be designed to accommodate a secondary device, such as scissors or another hand-held cutting implement, for cutting wrapped hair in a manner similar to the brushroll 90 of FIGS. 8-9. In one embodiment, ribs 106 and/or channel 108 can be provided in the dowel 152.

While the brushrolls 60, 90, 120, 150 are described herein as being rotatably driven by a motor, it is understood that the brushroll 60, 90, 120, 150 can be driven by other means, such as, but not limited to, a turbine fan or a mechanical gear train.

The vacuum cleaner 10 and various brushrolls 60, 90, 120, 150 disclosed herein provide an improved brushroll design which addresses the problem of hair wrap Embodiments of the present invention include brushroll designs in which the hair wrap angle A2 is less than or equal to the deflection angle A1 (in other words, where A2≤A1). Such brushrolls release hair that is not pulled off the brushroll by the suction force of the vacuum cleaner back on to the surface to be cleaned, rather than tightly wrapping the hair on the brushroll. These brushrolls provide the opportunity to prevent or greatly reduce the amount of hair wrap during operation. Other embodiments of the present invention include brushroll designs in which hair can easily be cut off the brushroll.

While the invention has been specifically described in connection with certain specific embodiments thereof, it is to be understood that this is by way of illustration and not of limitation. Reasonable variation and modification are possible with the scope of the foregoing disclosure and drawings without departing from the spirit of the invention which, is defined in the appended claims. Hence, specific dimensions and other physical characteristics relating to the embodiments disclosed herein are not to be considered as limiting, unless the claims expressly state otherwise.

What is claimed is:

1. A vacuum cleaner comprising:

a base comprising an agitator chamber and a suction nozzle opening in fluid communication with the agitator chamber;

an upright body pivotally mounted to the base and comprising a main support section supporting a cyclonic collection system comprising a cyclone separator;

a suction source in fluid communication with the cyclonic collection system; and a brushroll positioned within the agitator chamber for rotational movement about a central rotational axis, the brushroll comprising:

a brush dowel configured to be mounted for rotation about the central rotational axis, which extends longitudinally through the brush dowel, and comprising:

opposing bristle supports defining mounting surfaces; and a shroud surface comprising opposing convex curved surfaces extending between the opposing bristle supports; and a plurality of bristle tufts fastened to each of the opposing bristle supports and projecting from one of the mounting surfaces;

wherein the mounting surfaces intersect the convex curved surfaces at outside corners, the mounting surfaces comprise concave curved surfaces extending between the outside corners and recessed inwardly toward the central rotational axis, below the shroud surface and wherein the plurality of bristle tufts project from the concave curved surfaces between the outside corners.

2. The vacuum cleaner of claim 1 wherein the opposing bristle supports extend helically around the brush dowel relative to the central rotational axis and multiple bristle tufts of the plurality of bristle tufts are fastened to each bristle support and arranged in a helically-extending row on the mounting surfaces.

3. The vacuum cleaner of claim 1 wherein an outer surface of the brush dowel consists of the opposing bristle supports and the opposing convex curved surfaces.

4. The vacuum cleaner of claim 1 wherein the brush dowel comprises a first axis of symmetry and a second axis of symmetry that is orthogonal to the first axis of symmetry.

5. The vacuum cleaner of claim 1 wherein bristle tufts of the plurality of bristle tufts are offset on the concave curved surfaces such that each bristle tuft is non-equidistant from the outside corners.

6. The vacuum cleaner of claim 1 wherein each of the plurality of bristle tufts lies on a centerline axis extending orthogonally through the center of the bristle tuft and the each of the concave curved surfaces defines a centerline axis extending orthogonally through the center of the concave curved surface, and the centerline axis of one bristle tuft and the centerline axis of the associated concave curved surface intersect outward of the brush dowel at an acute angle.

7. The vacuum cleaner of claim 6 wherein bristle tufts of the plurality of bristle tufts are offset on the concave curved surfaces such that each bristle tuft is non-equidistant from the outside corners.

8. The vacuum cleaner of claim 1 wherein the vacuum cleaner is one of an upright-type vacuum cleaner, a canister-type vacuum cleaner, a stick vacuum cleaner, an autonomous vacuum cleaner, or a hand-held vacuum cleaner.

9. A brushroll for a vacuum cleaner, comprising:

a brush dowel configured to be mounted for rotation about a central rotational axis, which extends longitudinally through the brush dowel, and comprising:

opposing bristle supports defining mounting surfaces; and a shroud surface comprising opposing convex curved surfaces extending between the opposing bristle supports; and a plurality of bristle tufts fastened to each of the opposing bristle supports and projecting from one of the mounting surfaces;

wherein the mounting surfaces intersect the convex curved surfaces at outside corners, the mounting surfaces comprise concave curved surfaces extending between the outside corners and recessed inwardly toward the central rotational axis, below the shroud surface and wherein the plurality of bristle tufts project from the concave curved surfaces between the outside corners.

10. The brushroll of claim 9 wherein the opposing bristle supports extend helically around the brush dowel relative to the central rotational axis and multiple bristle tufts of the plurality of bristle tufts are fastened to each bristle support and arranged in a helically-extending row on the mounting surfaces.

11. The brushroll of claim 9 wherein the plurality of bristle tufts are arranged in one of a straight, angled, or helical pattern on the brush dowel.

12. The brushroll of claim 9 wherein an outer surface of the brush dowel consists of the opposing bristle supports and the opposing convex curved surfaces.

13. The brushroll of claim 9 wherein the brush dowel comprises a first axis of symmetry and a second axis of symmetry that is orthogonal to the first axis of symmetry.

14. The brushroll of claim 9 wherein bristle tufts of the plurality of bristle tufts are offset on the concave curved surfaces such that each bristle tuft is non-equidistant from the outside corners.

15. The brushroll of claim 9 wherein each of the plurality of bristle tufts lies on a centerline axis extending orthogonally through the center of the bristle tuft and the each of the concave curved surfaces defines a centerline axis extending orthogonally through the center of the concave curved surface, and the centerline axis of one bristle tuft and the centerline axis of the associated concave curved surface intersect outward of the brush dowel at an acute angle.

16. The brushroll of claim 15 wherein bristle tufts of the plurality of bristle tufts are offset on the concave curved surfaces such that each bristle tuft is non-equidistant from the outside corners.

* * * * *